US007565776B2

(12) United States Patent
Wolf et al.

(10) Patent No.: US 7,565,776 B2
(45) Date of Patent: Jul. 28, 2009

(54) ESCAPE MECHANISM FOR HURRICANE SHUTTERS

(75) Inventors: Edward A. Wolf, Parkland, FL (US); Mark Clark, Loxahatchee, FL (US)

(73) Assignee: Integridyne LC, Parkland, FL (US)

( * ) Notice: Subject to any disclaimer, the term of this patent is extended or adjusted under 35 U.S.C. 154(b) by 396 days.

(21) Appl. No.: 10/908,999

(22) Filed: Jun. 3, 2005

(65) Prior Publication Data

US 2006/0283131 A1 Dec. 21, 2006

(51) Int. Cl.
*E06B 3/26* (2006.01)

(52) U.S. Cl. ..... 52/202; 52/203; 292/301; 49/463; 49/465

(58) Field of Classification Search ..... 52/202–203; 49/463, 465, 41, 50; 292/155, 301
See application file for complete search history.

(56) References Cited

U.S. PATENT DOCUMENTS 2,012,388 A * 8/1935 Goodman ..... 52/202
4,258,504 A 3/1981 Hicks
4,263,747 A 4/1981 Coltrin et al.
4,897,961 A * 2/1990 Shine ..... 49/141
5,174,063 A 12/1992 Lewis et al.
5,181,548 A * 1/1993 Matthews ..... 160/172 R
5,343,668 A * 9/1994 Gonzalez ..... 52/712
5,410,841 A * 5/1995 Harris et al. ..... 49/67
5,619,821 A 4/1997 St. George et al.
5,657,578 A 8/1997 Thompson
6,293,059 B1 9/2001 Goodwin
6,393,777 B1 5/2002 Renfrow
6,449,902 B1 9/2002 Tumin
6,532,702 B1 * 3/2003 Scribner ..... 52/202
6,607,224 B2 * 8/2003 Hodges ..... 292/303
7,325,365 B2 * 2/2008 Warner ..... 52/203
2002/0162286 A1 * 11/2002 Heissenberg ..... 52/202

* cited by examiner

*Primary Examiner*—Brian E Glessner
*Assistant Examiner*—James J Buckle, Jr.
(74) *Attorney, Agent, or Firm*—Malin Haley DiMaggio Bowen & Lhota, P.A.

(57) ABSTRACT

A hurricane shutter escape mechanism for allowing fast and easy removal of conventional hurricane shutters from a window or door of a structure in the event of an emergency. The device comprises a release member, an anchor, a removable stud for engaging and securing the hurricane shutters, and a spring-actuated panel fastener that includes a leaf spring to engage and hold the removable stud in position. The release member includes a slot having a small aperture to hold the stud in position and a large aperture to release the stud from the anchor. From inside the building, the release member is pushed down to release the hurricane shutters so that the occupants of a structure can escape during an emergency, such as a fire. From outside the building, a rescuer can depress the leaf spring to remove the spring-actuated panel fastener, and thereby, also remove the hurricane shutter panel.

15 Claims, 9 Drawing Sheets

ESCAPE MECHANISM FOR HURRICANE SHUTTERS

FIELD OF THE INVENTION

This invention relates to an indoor/outdoor hurricane shutter escape mechanism for hurricane shutters for ingress or egress in the event of an emergency.

DESCRIPTION OF RELATED ART

In the southeastern United States as well as other areas of the world prone to receiving tropical storms, hurricane or storm shutters are a virtual necessity for homes and businesses in coastal areas. While providing protection from high winds and flying debris during the onslaught of a hurricane or tropical storm, conventional hurricane shutters represent an inherent danger to those who take shelter behind them. During emergency situations, and particularly in the case of fires, people are frequently trapped inside their homes and cut off from normally available escape routes through the windows and doors due to the manner in which conventional shutters are fastened securely to a building. Currently, many hurricane shutters are firmly attached to the exterior of a building by a plurality of threaded fasteners. Each fastener must be individually and manually removed from the outside of the house by unscrewing or otherwise unfastening the shutters from the exterior walls requiring a large amount of time and effort. For this reason, conventional hurricane shutters pose a great risk to life, and numerous incidents are reported of persons succumbing to smoke and fire because they were unable to exit their homes due to being trapped behind the shutters covering the windows and doors. With most hurricane shutters, inhabitants cannot access the exterior fasteners from the interior of the house, while a rescuer, such as a fireman, outside the shuttered building must remove numerous threaded fasteners to remove a few shutter panels to expose the windows and provide a point of entry into the building.

U.S. Pat. No. 6,293,059, issued to Goodwin on Sep. 25, 2001, describes a hurricane protective system for windows and doors; however, the system described includes panels that are solidly attached over windows and doors but do not include any quick release mechanism for removing said panels to escape during an emergency. Likewise, U.S. Pat. No. 2,012,388, issued to Goodman on Aug. 27, 1935, also describes a metal plate that is to be secured over a window with studs. The '388 patent does not provide any means for quickly removing the shutter in case of an emergency.

U.S. Pat. No. 5,657,578, issued to Thompson on Aug. 19, 1997, describes a fire escape window gate that allows for easy escape through a barred window shutter. The invention includes a barred gate for a window that allows the shutters to be swung open from inside the building but remain closed and secure on the building's exterior to prevent burglaries. The '578 invention differs from the applicants' invention in that the '578 patent describes gated protective shutters having bars for the purpose of preventing burglaries rather than for protecting a home and its occupants from wind damage. Moreover, the '578 invention is a permanent fixture once installed on a house, whereas the applicants' invention is intended to be used with temporarily installed hurricane storm shutters/panels. Unlike the '578 invention, the applicant's device easily connects to existing storm shutter/panel hardware without modification of the home and can be removed when the shutters are removed. Similarly, U.S. Pat. No. 5,619,821, issued to St. George et al., on Apr. 15, 1997, describes an easily-installed quick-release security grill with optional penetration-resistant rotating fins. The apparatus described by the '821 patent is permanently affixed to the window on which it is installed, and therefore, differs from the applicants' invention.

U.S. Pat. No. 5,174,063, issued to Lewis et al., on Dec. 29, 1992, describes a releasing system for a cover, such as a window grill, over an opening in a structure. The device includes a spring latch having an attached release cable and a penetrating member to secure the device to the structure. When the release cable is pulled with sufficient force, the spring latch pulls out of a notch, thereby releasing the penetrating member so that the window grill is released and becomes removable from the window of the structure. Several disadvantages are inherent in this apparatus, including that the '063 patented device is not easily installed, requires modification of the home, becomes a permanent installation, does not adapt to existing hurricane storm shutter/panel hardware, does not allow rescue personnel access to the home, and the components of the device are subject to significant wear, and thus, are more likely to malfunction during an emergency.

U.S. Pat. No. 4,263,747, issued to Coltrin et al., on Apr. 28, 1981, is for a window grill latch system that includes a latch or latches which are connected by a series of cables to a foot stirrup on the floor adjacent to the window. Each latch includes a spring-loaded retention means for engaging a penetrating member that is used to secure the side of the grill to the building. The '747 patent is disadvantaged in relation to the applicants' invention in that the '747 patent is not easily installed, requires modification of the home, becomes a permanent installation, does not adapt to existing hurricane store shutter/panel hardware, does not allow rescue personnel access to the home, and the components of the device are subject to significant wear, and thus, are more likely to malfunction during an emergency due, in part, to the device's complexity. U.S. Pat. No. 4,258,504, issued to Hicks on Mar. 31, 1981, includes a cable release connected to a spring-loaded plunger for releasing a security guard grill that is hinged to a window. The cable extends from the spring-loaded plunger to a foot treadle operator that the user steps upon to release the plunger from a plunger hole so that the guard grill can swing open. This invention is intended for use with a security window grill and is not designed for use with hurricane shutters.

U.S. Pat. No. 6,449,902, issued to Tumin on Sep. 17, 2002, describes a window shutter with a locking mechanism including a movable panel that is raised to cover a window by turning a manual crank. When not in use, the panel rests inside a passageway through the wall below the window frame, and can be raised or lowered by the operator. This invention differs from the applicants' invention in that the applicants' invention is designed to be used with removable temporary hurricane shutters while the '902 invention constitutes a permanent fixture that is installed as part of the structure of the windows on a building.

Finally, U.S. Pat. No. 6,393,777, issued to Renfrow on May 28, 2002, describes a window guard assembly which includes multiple window brackets permanently installed on the exterior sides of a window frame of a building. The '777 invention differs from the applicants' invention in that the applicants' invention does not require the installation of permanent brackets into the walls or window frames of a building. The '777 invention does not allow the removal or easy break-away of hurricane storm shutters/panels installed over an opening in a structure, is not easily installed, requires modification of the home, becomes a permanent installation, does not adapt to existing hurricane storm shutter/panel hardware, and does not allow rescue personnel access to the building.

SUMMARY OF THE INVENTION

This invention relates to a quick release shutter fastener that secures hurricane shutter panels firmly in place while also allowing manual quick and easy removal of the hurricane storm shutters and panels during an emergency, thereby providing an escape route to a structure's occupants as well as access by a rescuer attempting to enter the building through a window or door covered by hurricane storm shutter panels during an emergency. The hurricane shutter escape mechanism assembly includes an anchor that attaches to an existing wall and/or stud on the user's home/building. The fastener includes a stud that is removably connected to the anchor by a release mechanism.

In the preferred embodiment, the release member comprises a rigid flat member that includes an easily-visible handle that can be ergonomically pushed or pulled, an aperture that engages the removable stud, and an additional aperture that releases the stud when the release mechanism is pushed or pulled. The anchor mounted to the home/building's existing wall anchor stud receives the removable stud which is secured by the release member and engages the hurricane storm shutter/panel. The anchor comprises a body with recesses that engage the release member and allow the release member to be either pushed or pulled in relation to the removable stud. The removable stud can mate and lock onto the release member until said release member is pulled, at which time the release member disengages the removable stud and allows said stud's free unimpeded ejection/removal from the anchor. The release member includes an ergonomic feature for manually setting or releasing the stud used to anchor the hurricane storm shutter/panels at each location. The release member can be constructed to be accessed and pushed or pulled from the outside by a rescuer. Each shutter/panel selected for quick release by the user will install onto an applicable number of removable studs.

To operate the device, the anchor is mounted to the home/building's existing wall anchor studs and the removable stud is inserted into the anchor and retained by the release mechanism. The hurricane storm shutters/panels are then installed onto the studs of the device in the same manner they would install onto the home/building's existing wall anchor studs. An additional anchor, comprising a spring-actuated panel fastener, is then attached on the outside to the stud to secure the shutter/panel to the structure. The spring-actuated panel fastener body is constructed preferably from a high impact durable material and attaches directly to the stud that passes through the holes in the shutter/panels, thereby holding the panels in place. A metal leaf spring is attached to the panel fastener body using hardware such as a rivet. The leaf spring is angled relative to the panel fastener body end face and removable stud and includes a stud-locking aperture that is aligned with the central aperture of the panel fastener body. Pushing the spring-actuated panel fastener body onto the removable stud of the hurricane shutter escape mechanism causes the leaf spring to flex and reduces its angle relative to the removable stud. The decrease in this angle allows the relative diameter of the circular aperture of the leaf spring to increase and slide over the stud in only this one direction. Once movement in this direction has stopped, the spring's circular aperture under tension reduces its relative diameter and engages the stud to frictionally hold onto the stud. Movement in the opposite direction causes this friction to increase as the relative diameter of the leaf spring's circular aperture becomes smaller as the angle increases. To remove the spring-actuated panel fastener, the user must move the leaf spring in the direction that reduces the spring's angle and increases the circular aperture's relative diameter which reduces the friction and allows the panel fastener to be pulled off quickly and easily by manual activation during an emergency. In this embodiment of the invention, the release mechanism includes an easily-visible feature that can be ergonomically pushed or pulled by someone inside the building. The spring-actuated panel fastener is installed on the outside to secure the shutters/panels to the structure and allows the quick release and removal of the shutters/panels from the outside when manually activated. Thus, a number of hurricane shutter escape mechanisms are installed on the home/building in conjunction with each shutter/panel selected for quick release by the user. Each selected shutter/panel is secured to the home/building using an appropriate number of spring-actuated panel fasteners installed onto the studs of the hurricane shutter escape mechanisms. If a rescuer is outside and wants to gain access into the building, the rescuer must manually remove a sufficient number of the spring-actuated panel fasteners from a plurality of studs in order to quickly remove a sufficient number of shutters/panels off of the home/building to gain access into the home/building during the emergency.

In another embodiment, each of the shutter/panel release mechanisms could be linked together mechanically to allow the manual quick release of multiple shutters/panels at the same time. The shutters/panels could also be automatically released when connected to any type of fusable link.

Using this invention, hurricane shutter panels can be quickly and easily released to allow the escape and/or rescue of the occupants from a home/building during an emergency, using typical hardware such as a wingnut in place of the spring-actuated panel fastener described earlier. The hurricane storm shutters/panels are retained to the stud of the hurricane shutter escape mechanism assembly with typical hardware such as a wingnut. In this embodiment, the release mechanism incorporates an additional feature that is accessible from the outside to allow manual quick release of the shutters/panels by a rescue person needing to gain access into the home/building during an emergency. The user located inside the building or a rescuer outside of the building must pull upward or push downward on the release member so that the stud is disengaged from the previously described anchor and the panel fastener and removable stud are cast off allowing the shutters/panels to be quickly removed.

An object of this invention is to provide an easily-used, inexpensive, and reliable shutter release for quickly releasing conventional temporarily-installed hurricane storm shutters or panels or plywood coverings from their engagement with a structure to allow a quick escape from a home or building by the occupants in the event of an emergency.

Another object of this invention is to allow emergency personnel and others to quickly and easily access a home or building during an emergency, such as a fire, when the windows, doors and other covered openings of a home or building are secured by conventional hurricane storm shutters and panels, or plywood coverings.

Still another object of this invention is to provide a quick release mechanism for conventional hurricane storm shutters/panels or typical plywood coverings that can easily convert existing conventional storm shutter/panel mounting hardware over to the previously described hurricane shutter escape mechanisms without modification of the home/building.

Yet another object of this invention is to make the typical hurricane storm shutter/panel or typical plywood covering installation and removal process quicker and easier by eliminating the hassle of installing and removing numerous pieces of hardware, such as wingnuts, that are prone to jamming and/or breaking on each shutter/panel or typical plywood coverings, and use the previously described quick release spring actuated panel fasteners instead.

A further object of this invention is to allow spring-actuated panel fasteners to be used on all the storm shutters/panels or typical plywood coverings on a home/building and take advantage of the quick installation and removal benefits the spring-actuated panel fastener offers, instead of using typical retaining hardware such as wingnuts. This object is accomplished by installing studs specifically designed to mate with the spring-actuated panel fasteners, in place of or attached to the existing hurricane storm shutter/panel or typical plywood covering hardware of the home/building. This device can be used on any window/opening not selected as an escape path by the user. Use of this device makes easier the process of installing and removing hurricane season storm shutters/panels or typical plywood coverings and allows a rescue person to gain quick access to the home during an emergency. All other windows/openings selected as an escape path by the user would use the previously described hurricane shutter escape mechanism.

In accordance with these and other objects which will become apparent hereinafter, the instant invention will now be described with particular reference to the accompanying drawings.

DETAILED DESCRIPTION

Figure 1A:
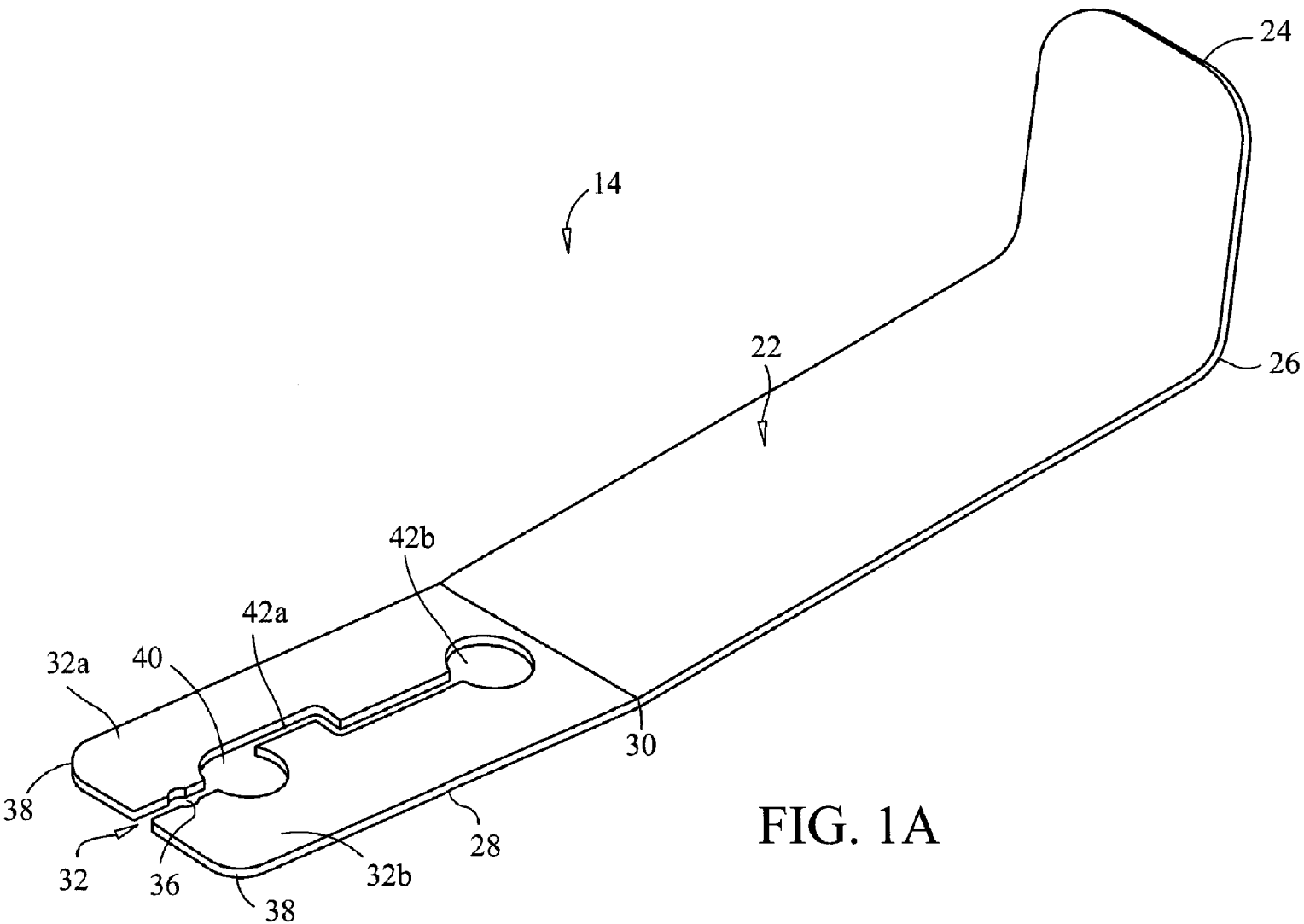
FIG. 1A shows a perspective frontal view of a release member.

The risk of fire in a building secured by a plurality of hurricane shutters or storm panels 12 has made necessary the ability to quickly and easily remove hurricane shutters from a shuttered window or door to allow the escape and/or rescue of the building's occupants. Applicant's invention 10 relates to a hurricane shutter escape mechanism 10 for quickly removing a conventional hurricane shutter 12 so as to allow a person to escape from a building through a shuttered window, door, or other opening in the event of an emergency. The device 10 can also be used to secure plywood coverings 12 over windows and other openings of buildings. Said hurricane shutter escape mechanism 10 comprises a release member 14, an anchor 16, a removable stud 18, and a spring-actuated panel fastener 20.

The release member 14 comprises a somewhat flexible, planar metallic member 22 having a rounded first end 24 with an adjacent L-shaped handle 26 proximal to said first end 24 and a tapered second end 28 having an angled portion 30 and a two-pronged, stud-releasing slot 32 that is sized and shaped so as to engage an annular groove 34 of the removable stud 18. The angled portion 30 of the release member 14 separates said second end 28 of the release member, which engages the anchor 16 and removable stud 18 perpendicularly, from said first end 24 of the release member 14 so that said first end 24 is angled toward the opening in the structure to which said device 10 is attached. The L-shaped handle 26 is ergonomically designed to be manually pressed or pulled by a user.

Figure 1B:
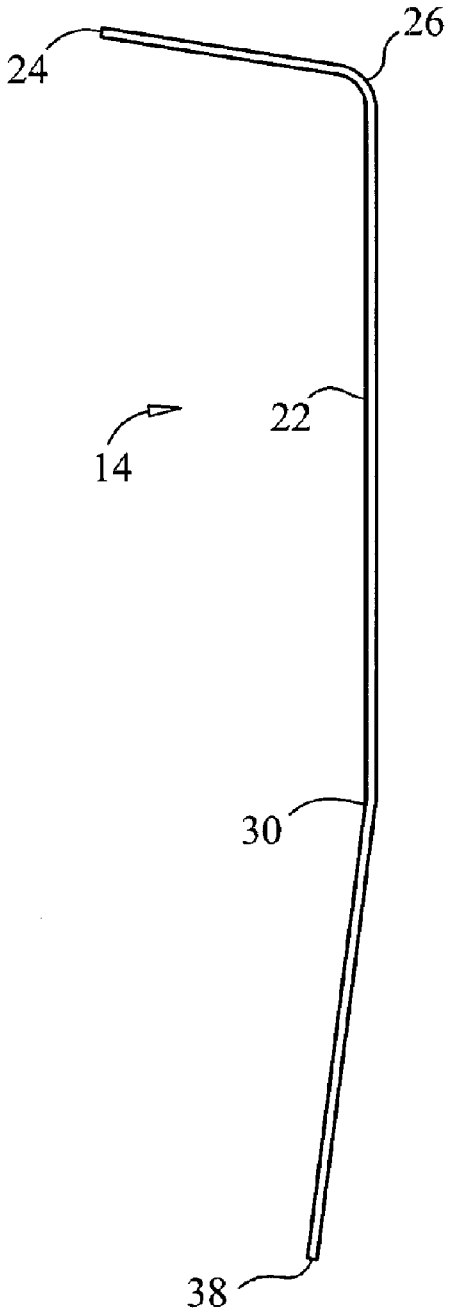
FIG. 1B shows an elevational right side view of a release member where the left side view of said release member is a mirror image of the illustration in FIG. 1B.
Figure 1C:
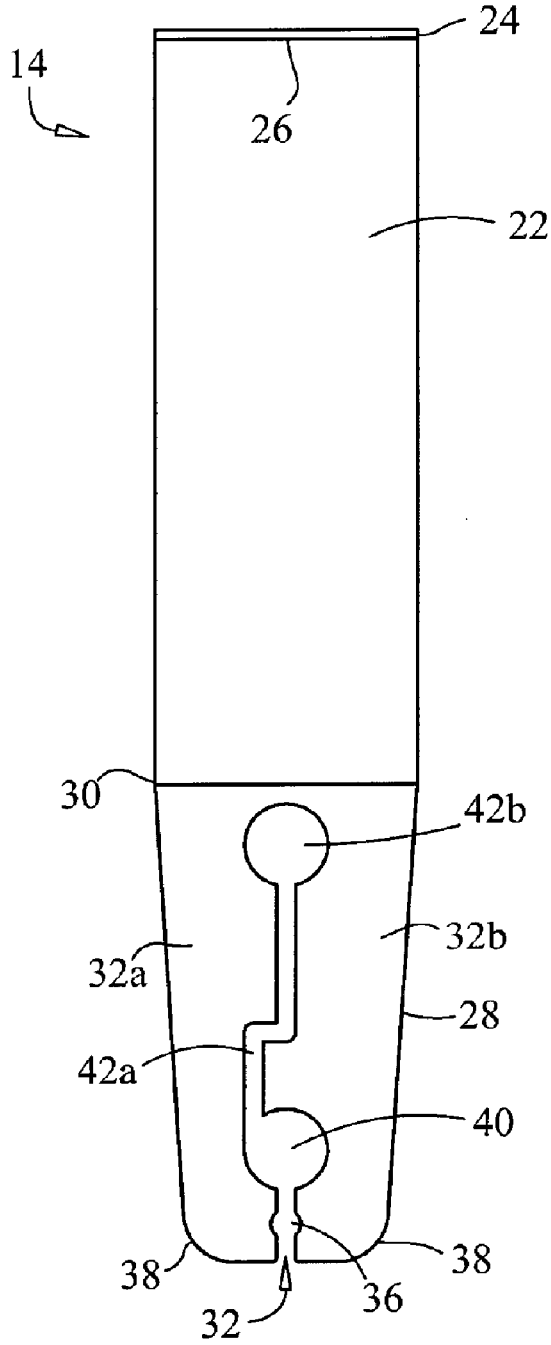
FIG. 1C shows a frontal side view of a release member where the left side view of said release member is a mirror image of the illustration in FIG. 5C.
Figure 2A:
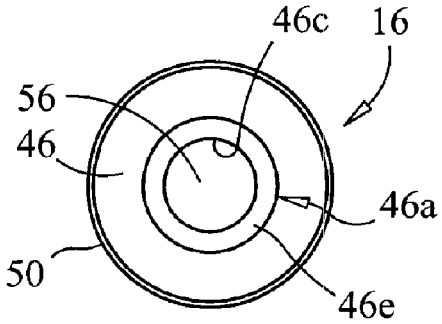
FIG. 2A shows a top view of an anchor.
Figure 2B:
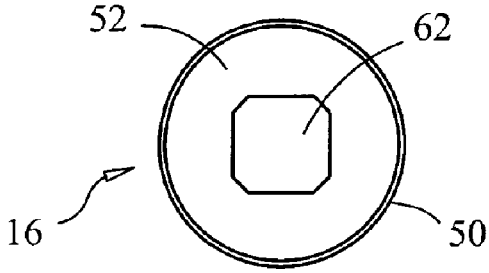
FIG. 2B shows a bottom view of an anchor.
Figure 2C:
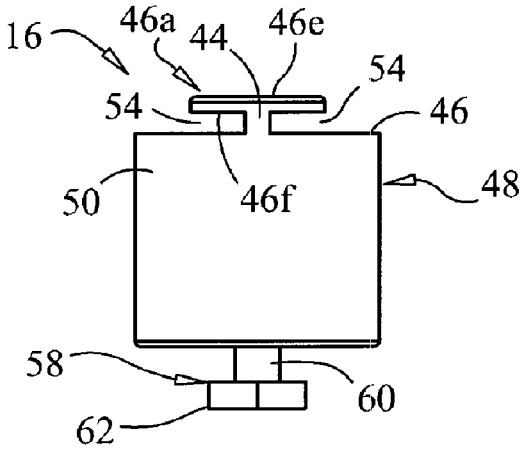
FIG. 2C shows an elevational front side view of an anchor where the back side view of said anchor is a mirror image of the illustration in FIG. 2C.
Figure 2D:
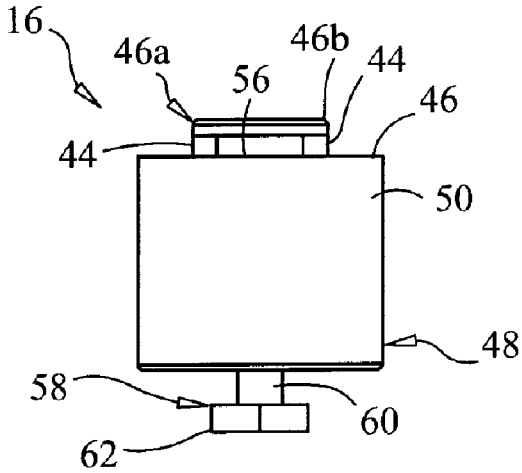
FIG. 2D shows an elevational left side view of an anchor rotated 90 degrees from the front side view in FIG. 2C where the right side view of said anchor is a mirror image of the illustration in FIG. 2D.
Figure 2E:
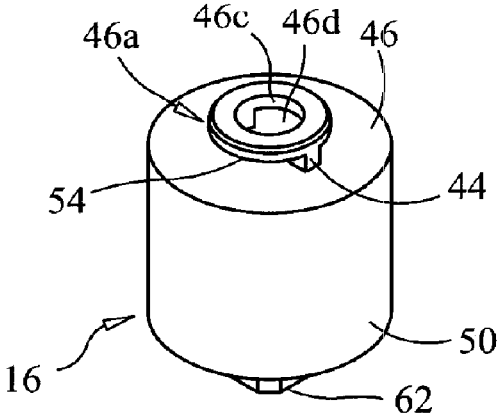
FIG. 2E shows a top perspective view of an anchor.
Figure 2F:
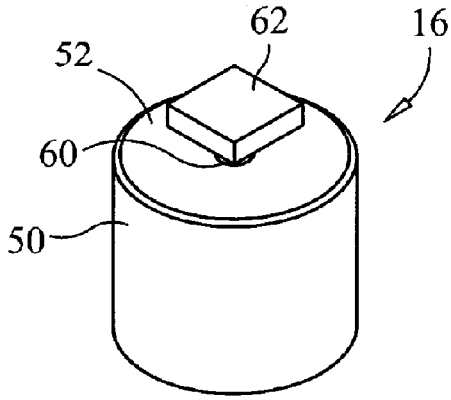
FIG. 2F shows a bottom perspective view of an anchor.

The stud-releasing slot 32 of the release member 14 includes a small recess aperture 36 that is located proximal to a tapered end tip 38 of the stud-releasing slot 32, and a large recess aperture 40 adjacent and connected to said small recess aperture 36 that when aligned with the removable stud 18 allows said removable stud to disengage from the anchor 16. Said large recess aperture 40 is preferably circular in shape. The large recess aperture 40 is sized so that, when the release member 14 is pushed down to unlock said release member such as during an emergency, the release member 14 can slide over and disengage from both removable stud 18 and a cylindrical protrusion 46*a* of a planar first end face 46 of the anchor 16. Said slot 32 of the release member 14 further includes preferably a narrow curved notch 42*a*, which is adjacent and connected to the large recess aperture 40, and which terminates in a large circular aperture 42*b* for providing resilient, spring-like action between two complementary prongs 32*a* and 32*b* forming said second end 28 and slot 32 of the release member. Thus, when the release member 14 is slidably engaged with the anchor 16 and the removable stud 18, prongs 32*a* and 32*b* flex apart slightly to receive the annular groove 34 of said stud 18 and return resiliently to a stable non-flexed configuration once the annular groove 34 of said removable stud 18 has passed into the small recess locking aperture 36. The slot 32 is also sized to receive two opposing metallic rectangular flanges 44 that support and connect the cylindrical protrusion 46*a* to the first end face 46 of said anchor 16. The flanges 44 are sized so as to freely pass into and out of the slot 32 without obstruction. The removable stud 18 can be moved between the recess aperture 36 and recess aperture 40 of said stud-releasing slot 32. The release member 14 is illustrated in FIGS. 1A through 1C.

Figure 5:
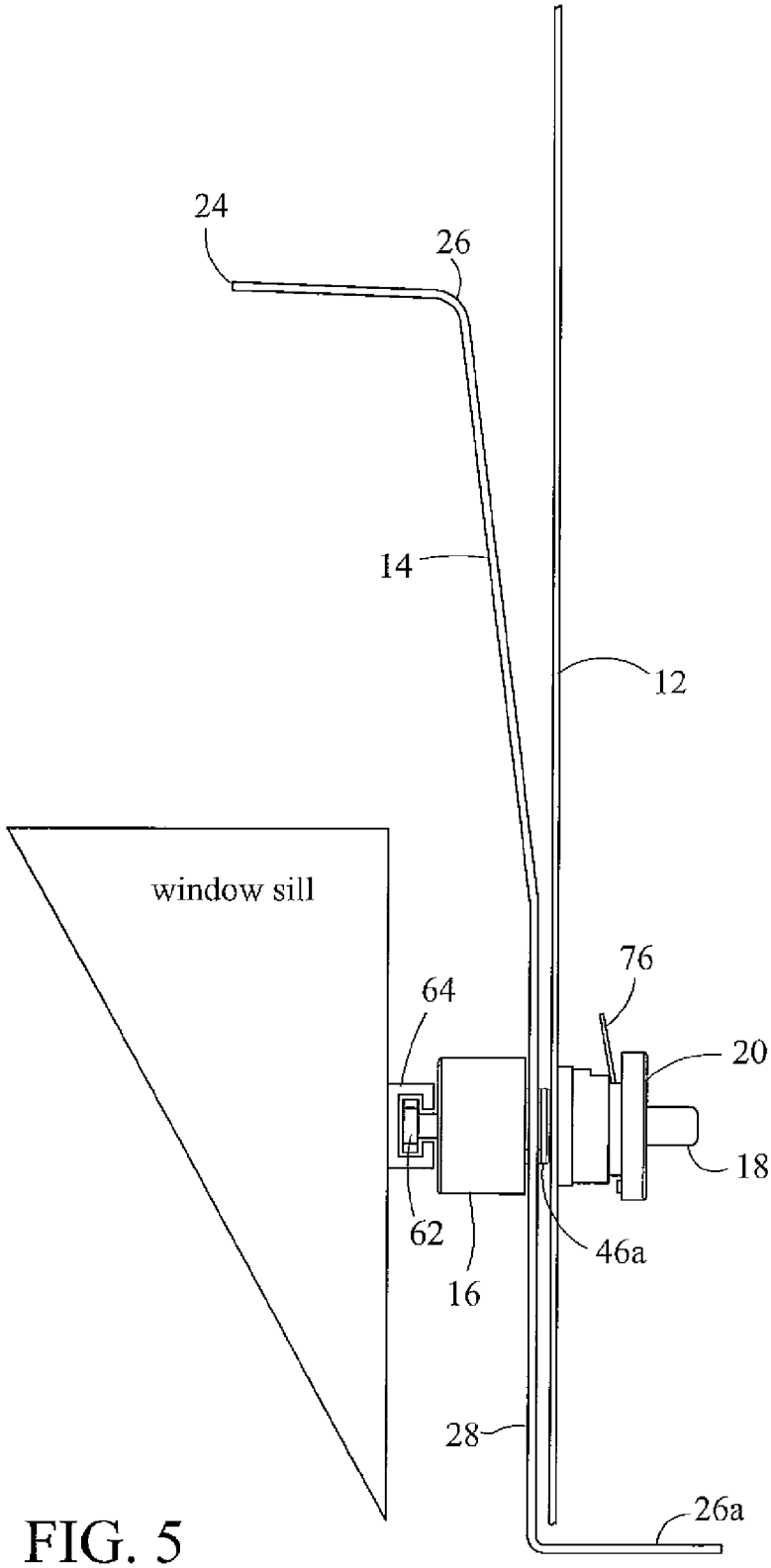
FIG. 5 shows the invention connected to a hurricane shutter panel and to a structure.

In FIG. 5, an alternate embodiment of the release member 14 is illustrated in which a second L-shaped handle 26*a* is located adjacent to the second end 28 of said release member 14. In this embodiment, the stud-releasing slot 32 and all of said slot's related components are adapted to continue receiving the removable stud 18 while providing L-shaped handle 26*a* as a means for rescuers outside the building to quickly remove the hurricane shutter 12 from the window or opening that said shutter covers. To use handle 26*a* from outside the building, a rescuer must push downward manually on said handle 26*a* to force the removable stud 18 from small recess aperture 36 into large recess aperture 40. Once the removable stud 18 enters the large recess aperture 40, said release member 14 is unlocked from stud 18 and said stud 18 can slide through large recess aperture 40 and disengage from the hurricane shutter 12.

FIGS. 2A through 2F illustrate the anchor 16 of the invention 10, which comprises a metallic cylindrical body 48 having a cylindrical outer wall 50, a planar first end face 46, a planar second end face 52, and the cylindrical protrusion 46*a* connected to first end face 46. The raised cylindrical protrusion 46*a* connected to said first end face 46 is separated from the main cylindrical body 48 and supported above the first end face 46 of the anchor 16 by the two opposing metallic rectangular flanges 44. Said cylindrical protrusion 46*a* includes a cylindrical outer wall 46*b*, a cylindrical inner wall 46*c* that surrounds a central aperture 46*d* of said cylindrical protrusion, a planar end face 46*e* including said central aperture for receiving said removable stud 18, and a bottom annular face 46*f* to which said flanges connect to attach said cylindrical protrusion 46*a* to said first end face 46 of the anchor 16. The central aperture 46*d* passes through the cylindrical protrusion 46*a* and is aligned with a central aperture 56 of the cylindrical body 48 of said anchor 16. Two mirror-image, release member retaining grooves 54 are positioned equidistantly apart on and through the outer cylindrical wall 46*b* of said cylindrical protrusion 46*a* where said outer wall 46*b* meets the first end face 46 of the anchor 16. Preferably, each of the rectangular flanges 44 extends from the inner wall 46*c* to the outer wall 46*b* of said cylindrical protrusion 46*a* on each flange's respective side of said protrusion 46*a*, however flanges of alternative positions, shapes, and sizes also may be used effectively. Preferably, the diameter of the cylindrical protrusion 46*a* is approximately one-half of the diameter of the first end face 46 of the cylindrical body 48.

The first end face 46 of said anchor 16 has a central aperture 56 that preferably extends through approximately one-third to one-half of the depth of said cylindrical body 48. The central aperture 56 of the cylindrical body 48 and the central aperture 46*d* that extends through the cylindrical protrusion 46*a* are aligned so as to receive insertion of removable stud 18. The second end face 52 of the anchor 16 has a necked flange 58 comprised of a small, preferably cylindrical, shaft 60 centrally positioned on the second end face 52 and a slidable plate 62 connected to a distal end of said cylindrical shaft 60. Said slidable plate 62 is preferably square or rectangular in shape, although other shapes may also be employed. The slidable plate 62 is engaged with a bracket 64 shaped for receiving a slidable plate and either temporarily or permanently affixed to the home or building. The necked flange 58 and slidable plate are the preferred means for securing the anchor 16 to a building, however, other connecting means may be used to attach said anchor to existing hardware that is already connected to the exterior of said building.

In an alternate embodiment of the invention, the necked flange 58 and the slidable plate 62 are attached to the second end face 52 of the anchor 16 at an angle to provide easier engagement with existing hardware connected to the building at the corners of windows and other openings to be secured by hurricane shutter panels 12.

In another embodiment of the invention, a threaded screw-like member (not shown in the drawings) is centrally attached solidly to the second end face 52 of said anchor 16 so that said anchor and said threaded screw-like member form one solid unit. To secure the anchor 16 to the building, said screw-like member is screwed into a predrilled hole in the exterior of the building or into a female threaded anchor preinstalled in the exterior wall or other surface of said building (especially where said exterior wall is concrete). In this particular embodiment, the anchor 16 does not include the necked flange 58 and slidable plate 62 attached to the second end face 52 of said anchor 16.

In yet another embodiment of the invention, the central aperture 56 passes entirely through the cylindrical body 48 of said anchor 16. This embodiment of the anchor 16 does not include the necked flange 58 and slidable plate 62 attached to the second end face 52 of said anchor 16. A screw (not shown in the drawings) is inserted through central aperture 46*d*, which extends through the cylindrical protrusion 46*a* of the anchor 16, and into central aperture 56. A head of the screw is retained by an annular flange that protrudes into and is smaller than the diameter of the central aperture 56. Said screw is screwed securely into a predrilled hole in the exterior of the building or into a female threaded anchor preinstalled in the exterior wall or other surface of said building (especially where said exterior wall is concrete).

In still another embodiment of the invention, a wall of the central aperture 56, which passes entirely through the cylindrical body 48 of said anchor 16 in this embodiment, is threaded so that said anchor 16 can be fitter over and screwed onto a threaded stud that is preinstalled on the exterior wall of the building. This allows said anchor 16 to be secured to the building where a permanently or removably affixed stud is installed on an exterior wall or other surface of the building rather than a bracket 64 shaped for receiving a slidable plate. In this embodiment, the anchor 16 does not include the necked flange 58 and slidable plate 62 attached to the second end face 52 of said anchor 16.

Figure 3A:
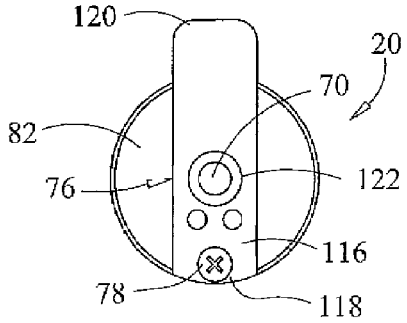
FIG. 3A shows a top view of a spring-actuated panel fastener with a leaf spring attached and engaging a removable stud.
Figure 3B:
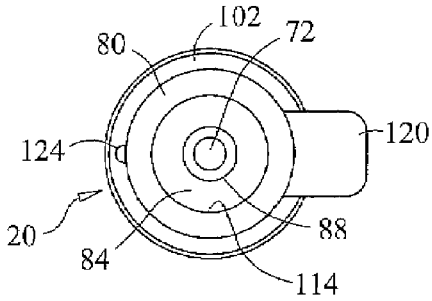
FIG. 3B shows a bottom view of a spring-actuated panel fastener.
Figure 3C:
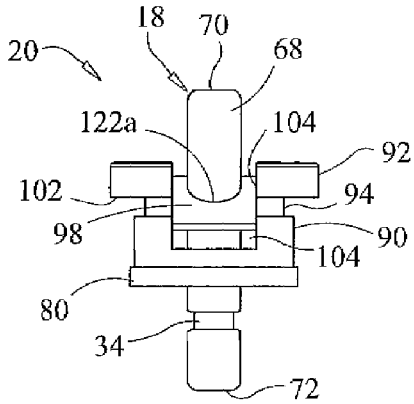
FIG. 3C shows an elevational front side view of a spring-actuated panel fastener.
Figure 3D:
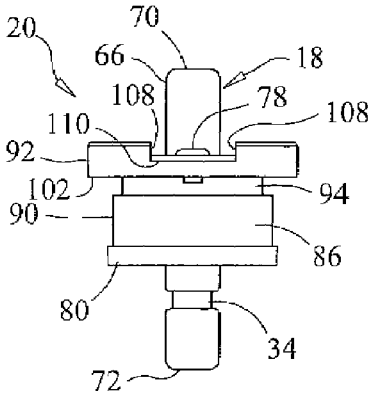
FIG. 3D shows an elevational back side view of a spring-actuated panel fastener.
Figure 3E:
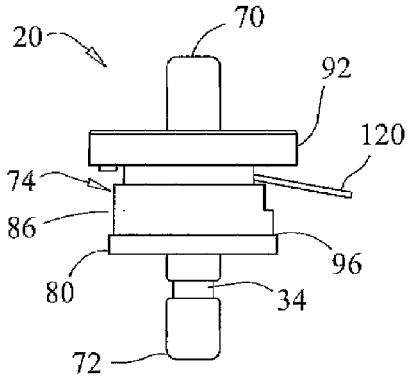
FIG. 3E shows an elevational left side view of a spring-actuated panel fastener rotated 90 degrees from the front view in FIG. 3D where the right side view of said spring-actuated panel fastener is a mirror image of the illustration in FIG. 3E.
Figure 3F:
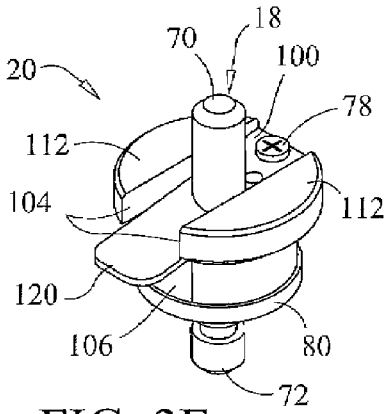
FIG. 3F shows a perspective view of a spring-actuated panel fastener.
Figure 4A:
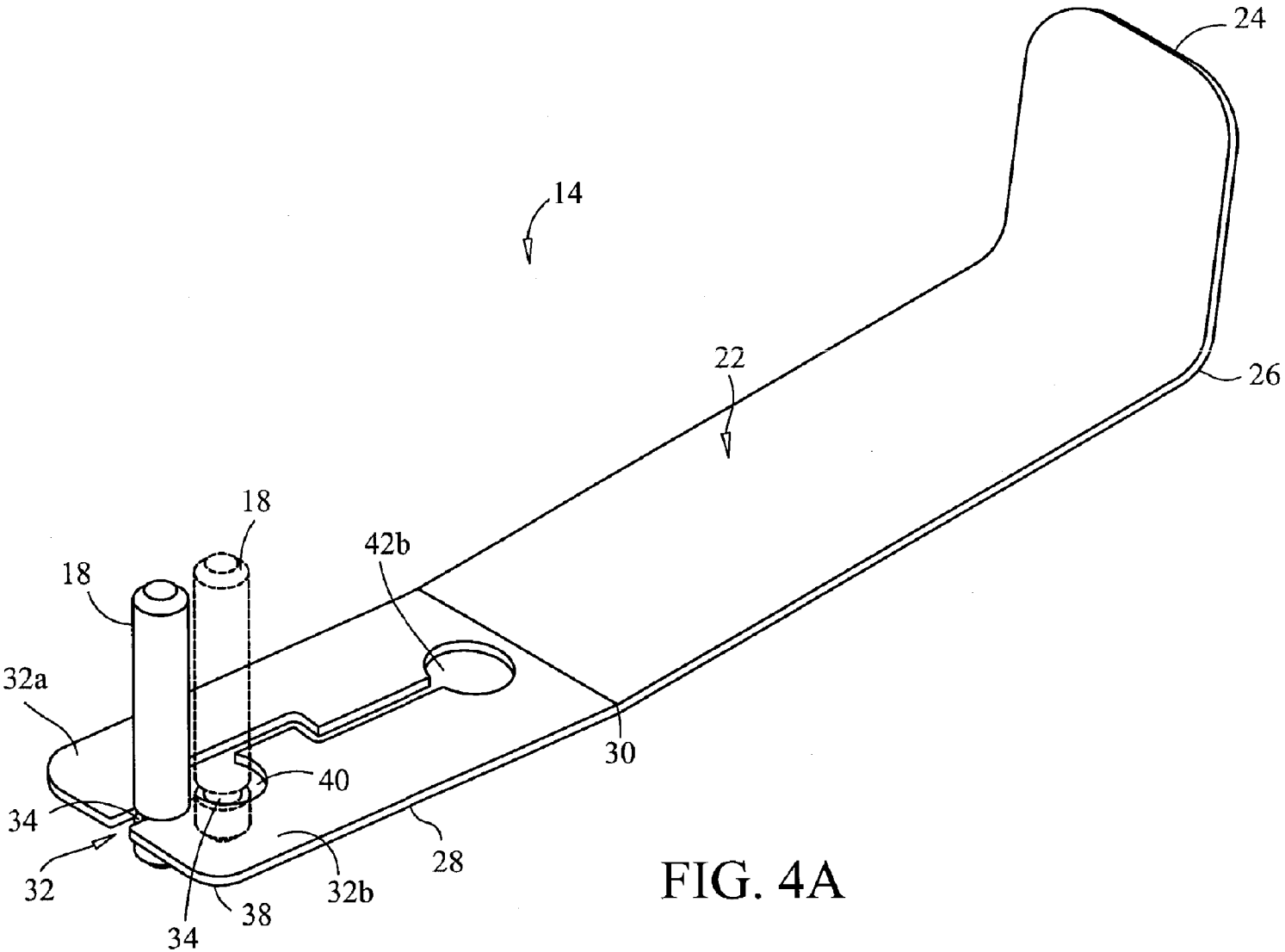
FIG. 4A shows a perspective view of a stud locked in a small recess aperture of a release member as well as a phantom view of a stud positioned inside a large recess aperture of said release member.
Figure 4B:
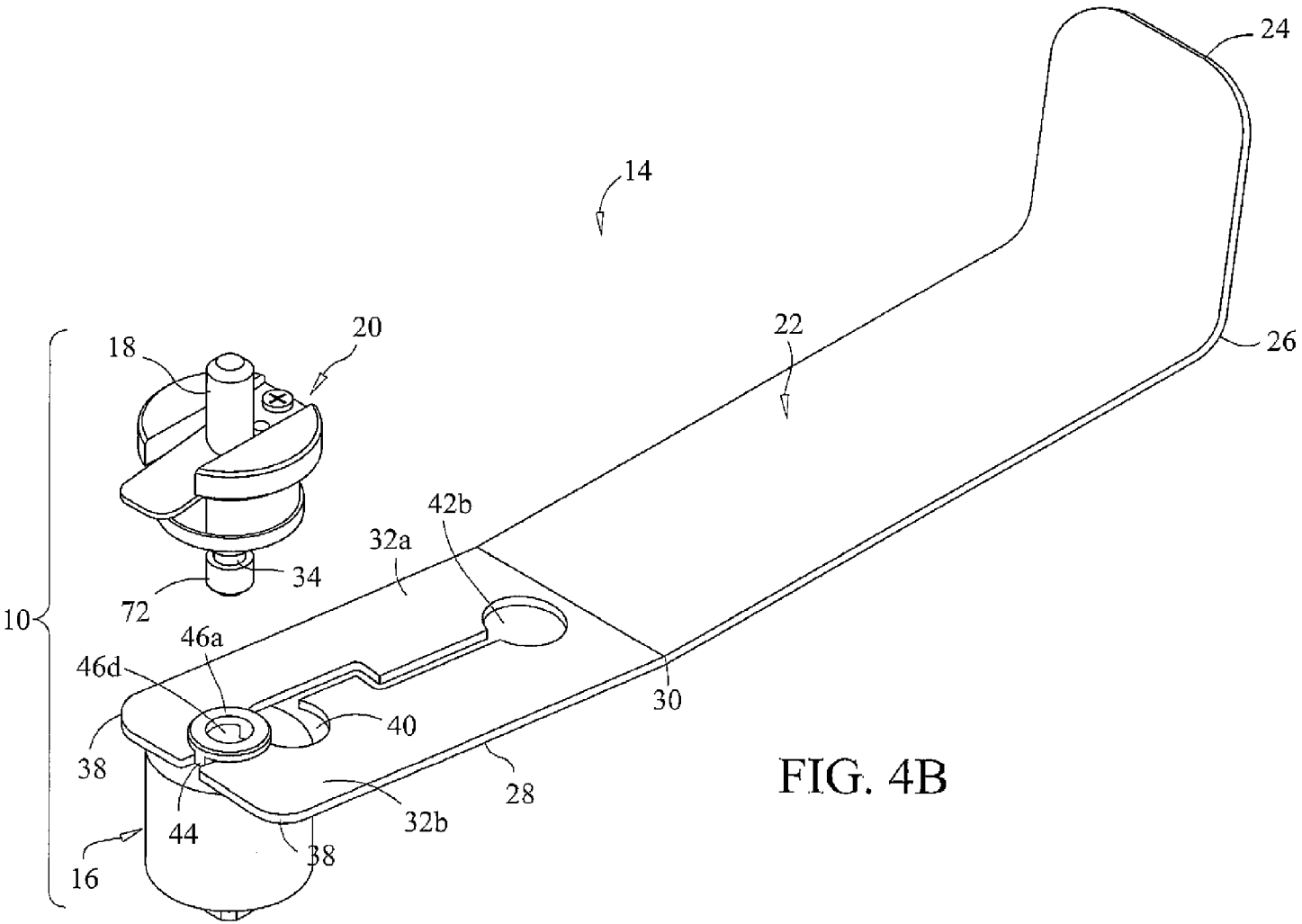
FIG. 4B shows a perspective view of a hurricane shutter escape mechanism engaged with a stud but not engaging a hurricane shutter panel and with an anchor inserted into the stud-receiving slot of a release member.

As shown in FIGS. 3C and 3F, the removable stud 18 of said invention 10 comprises a metal dowel 66 having a cylindrical outer wall 68, a rounded first end 70, a rounded second end 72, and an annular groove 34 adjacent to said first end 70 for engaging the stud-releasing slot 32 of the release member 14. In an alternate embodiment, the second end 72 of said stud 18 may be threaded for engaging a wingnut to secure the shutter panel 12 to a building. FIG. 4A illustrates the stud 18 inserted through the small recess aperture 36 of the release member 14 and a phantom view of said stud inserted through the large recess aperture 40 of said release member. FIG. 4B shows an exploded view of the stud 18 engaged with the spring-actuated panel fastener 20 and the cylindrical protrusion 46*a* of anchor 16 positioned in the small recess aperture 36 of said release member 14. The removable stud 18 may include numerous annular grooves (not shown in the drawings) on the cylindrical outer wall 68 of said stud 18.

The spring-actuated panel fastener 20, illustrated in FIGS. 3A through 3F, comprises a panel fastener body 74, a manually-releasable leaf spring 76, a rivet 78 for attaching said leaf spring 76 to said panel fastener body 74, and a washer 80 attached to the panel fastener body 74. Said spring-actuated panel fastener 20 serves to engage the removable stud 18 at a surface of the hurricane shutter 12 on a side opposite that of the anchor 16 to secure said shutter within the hurricane shutter escape mechanism 10 so that said shutter is mounted firmly in position over an opening in a structure. The panel fastener body 74 of said spring-actuated panel fastener 20 includes a planar first face 82, a planar second face 84, a cylindrical outer wall 86, and a central aperture 88 for receiving the removable stud 18. Said panel fastener body 74 further comprises a cylindrical base portion 90 that includes said second face 84 and said outer cylindrical wall 86. Said panel fastener body 74 also includes a cylindrical top portion 92 that has a greater diameter than said cylindrical base 90 and that includes said first face 82.

The panel fastener body 74 further includes a first annular groove 94 and a second annular groove 96 as well as a first recess 98 and a second recess 100. The first annular groove 94 is cut into the cylindrical wall 86 of said panel fastener body 74 so that said groove 94 is located adjacent to a bottom face 102 of the cylindrical top portion 92 of the panel fastener body. Thus, the first annular groove 94 separates said cylindrical base portion 90 from said cylindrical top portion 92 of the panel fastener body 74. The second annular groove 96 is cut around the cylindrical wall 86 of said cylindrical base 90 adjacent to said second face 84 so that said second face 84 has a diameter that is smaller than the diameter of the cylindrical base 90.

The first recess 98 of the panel fastener body 74 has three flat walls 104 and a planar bottom surface 106 and is cut from the panel fastener body 74 across approximately four-fifths of the width and through three-fourths of the depth of said panel fastener body 74. Moreover, the first recess 98 is cut out from both the cylindrical top portion 92 and the cylindrical base 90 of the panel fastener body 74 as shown in FIGS. 3A, 3C, and 3F. Said second recess 100 of the panel fastener body 74 is shallow having two opposing flat walls 108 and a planar bottom surface 110 and being cut out from one-half the depth of said cylindrical top portion 92 through said first face 82. The planar bottom surface 110 of said second recess 100 further includes a threaded, circular aperture 124, which penetrates the cylindrical top portion 92, for receiving a rivet 78 or screw 78 that is inserted into said aperture 124 to attach the leaf spring 76 to said panel fastener body 74. The central aperture 124 penetrates both the first face 82 and the planar bottom surface 110 of the second recess 100 of the panel fastener body 74. The first and second recesses 98, 100 are connected to one another and have identical widths so that said cylindrical top portion 92 is bisected into two complementary, partially hemispherical halves 112.

As illustrated in FIGS. 3A through 3F, the leaf spring 76 of the spring-actuated panel fastener 20 is comprised of a metallic tension leaf spring 76 having a width that is slightly less than the width of said first recess 98 and said second recess 100 of the panel fastener body 74 so that said leaf spring 76 may be set into said first and said second recesses 98, 100 and connected to said panel fastener body 74 on the planar bottom surface 110 of the shallow second recess 100. Said metallic leaf spring 76 is constructed preferably from stainless steel. Said spring 76 includes a short, horizontally planar end 116 of sufficient length to fit smoothly and precisely into the shallow second recess 100 of said panel fastener body 74. A circular aperture 118, which penetrates said planar end 116 of the spring 76, is sized to receive the rivet 78 or screw 78, which attaches said leaf spring 76 to said panel fastener body 74. Said leaf spring 76 also has a longer angled end 120 for providing spring tension to engage and hold the removable stud 18. The angled end 120 of said leaf spring 76 includes a locking aperture 122 having a diameter great enough to precisely fit and receive the removable stud 18 that is inserted therethrough to secure a hurricane shutter 12 to the building to be protected, said locking aperture 122 being aligned with the central aperture 88 of the panel fastener body 74. Preferably, said leaf spring 76 has a length that is greater than the width of the cylindrical top portion 92 of the panel fastener body 74 to allow easy handling by the user. Therefore, said angled end 120 preferably extends beyond the diameter of the cylindrical top portion 92 of the panel fastener body 74.

The leaf spring 76 is attached to the panel fastener body 74 by means of a rivet 78 or screw 78 that is inserted into the circular aperture 118 located on the horizontally planar end 116 of the spring 76. The aperture 118 on the planar end 116 of the spring 76 is aligned with the threaded, circular aperture 124 of the panel fastener body 74 so that the rivet 78 or screw 78 can be inserted through the aligned apertures 118 and 124 for attaching said leaf spring 76 to said panel fastener body 74.

The longer angled end 120 of said leaf spring 76 can be held and pushed upward by the user to decrease the tension exerted by said spring 76 on the outer cylindrical wall 68 of the removable stud 18. By placing force on the leaf spring 76, the angle at which an inner wall 122*a* of the locking aperture 122 of said leaf spring 76 contacts the cylindrical wall 68 of removable stud 18 is altered. Therefore, the relative diameter of the locking aperture 122 is changed in relation to fixed position of the removable stud 18 while said stud is engaged by release member 14. At rest, the locking aperture wall 122*a* of said leaf spring 76 contacts the removable stud 18 and prevents said removable stud 18 from being released from the invention 10 due to the tension exerted by the spring 76 against said removable stud 18. The leaf spring 76 engages said removable stud 18 in a locking configuration when not being depressed by the user due to the angle at which the locking aperture wall 122*a* of said spring 76 contacts the cylindrical wall 68 of said removable stud 18. Where a removable stud 18 having annular grooves on the cylindrical outer wall 68 is used, said locking aperture wall 122*a* of said leaf spring 76 contacts said stud 18 within one of the grooves, thereby providing a stronger, more effective locking effect on said removable stud. FIG. 3F illustrates a removable stud 18 inserted through a central aperture 88 of a panel fastener body 74. Said leaf spring 76 releases said removable stud 18 when pushed or pulled upward against the angle of the angled end 120 of said spring 76 due to a relaxation from contact by the removable stud 18 with the aperture wall 122*a* of said spring 76.

The circular, annular washer 80 of the spring-actuated panel fastener 20 has approximately the same diameter as the cylindrical base 90 of the panel fastener body 74 and includes a central aperture 114 that is inserted over and around the second annular groove 96 of said panel fastener body 74 so that said washer 80 is nearly flush with the planar second face 84 and outer cylindrical wall 86 of said panel fastener body 74. Preferably, said washer 80 is constructed from rubber or another elastomer material.

In an alternate embodiment, the spring-actuated panel fastener 20 can be replaced with a wingnut that is engaged with removable stud 18. In that embodiment, the second end 72 of said removable stud 18 must be threaded for engaging said wingnut.

Figure 6A:
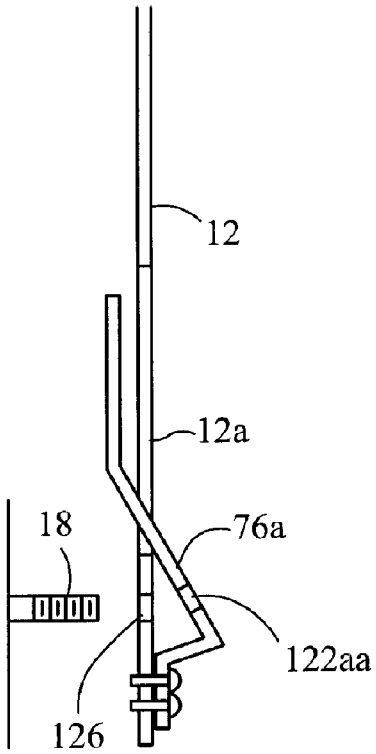
FIG. 6A shows an elevational side view of one embodiment of the invention in which a leaf spring is attached directly to a hurricane shutter panel, said leaf spring being an escape mechanism that is accessible from both inside and outside of the building.
Figure 6B:
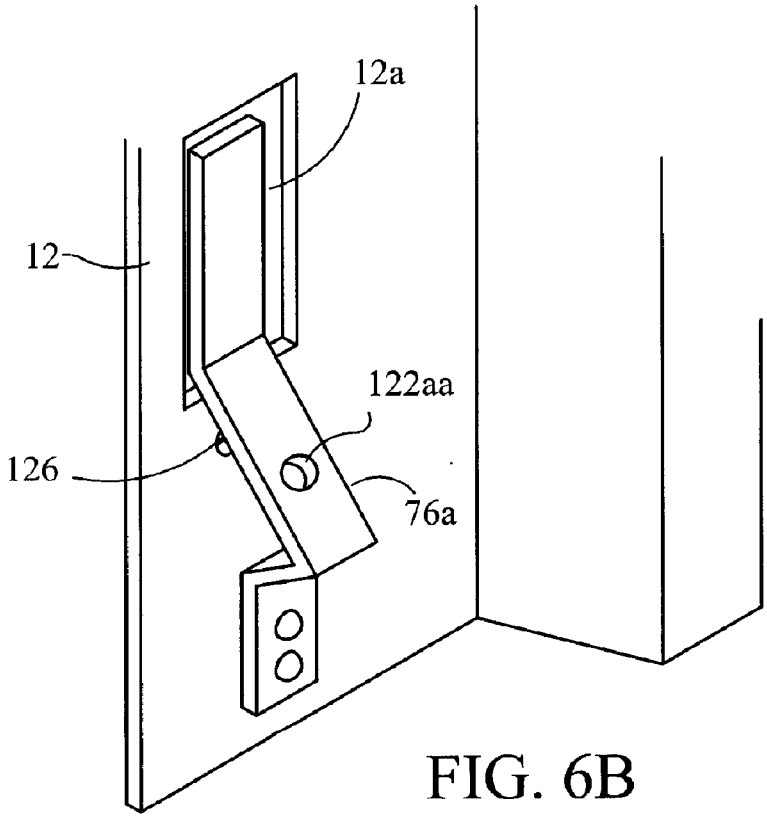
FIG. 6B shows a perspective view of the leaf spring from the embodiment of the invention illustrated in FIG. 6A.

In another alternate embodiment of the invention 10, the spring-actuated panel fastener 20 can be replaced by using a hurricane shutter 12 that includes one or more apertures 126 shaped and sized to receive the insertion of removable stud 18. As shown in FIGS. 6A and 6B, a shutter-mounted, angled leaf spring 76*a* is attached to the shutter 12 so that the locking aperture 122*aa* of said shutter-mounted spring 76*a* and aperture 126 through said shutter are aligned. Tension exerted by the shutter-mounted spring 76*a* would be used to hold and release removable stud 18 in the same manner described above for leaf spring 76. An end portion of said leaf spring 76*a* is angled to pass through an aperture 12*a* passing through the shutter panel 12 so that said leaf spring may be manually actuated by an occupant inside the building to release the stud 18, thereby allowing the occupants of said building to escape. Said aperture 12*a* also permits a rescuer outside of the building to manually actuate the leaf spring 76*a* to release stud 18 so that said hurricane shutter panels 12 may be removed to allow the rescue of occupants inside the building. As illustrated by FIGS. 6A and 6B, use of the spring-actuated panel fastener becomes unnecessary when a shutter-mounted leaf spring 76*a* is attached to a shutter 12, and thus, said panel fastener is not included as a part of the invention in this particular embodiment.

Figure 7:
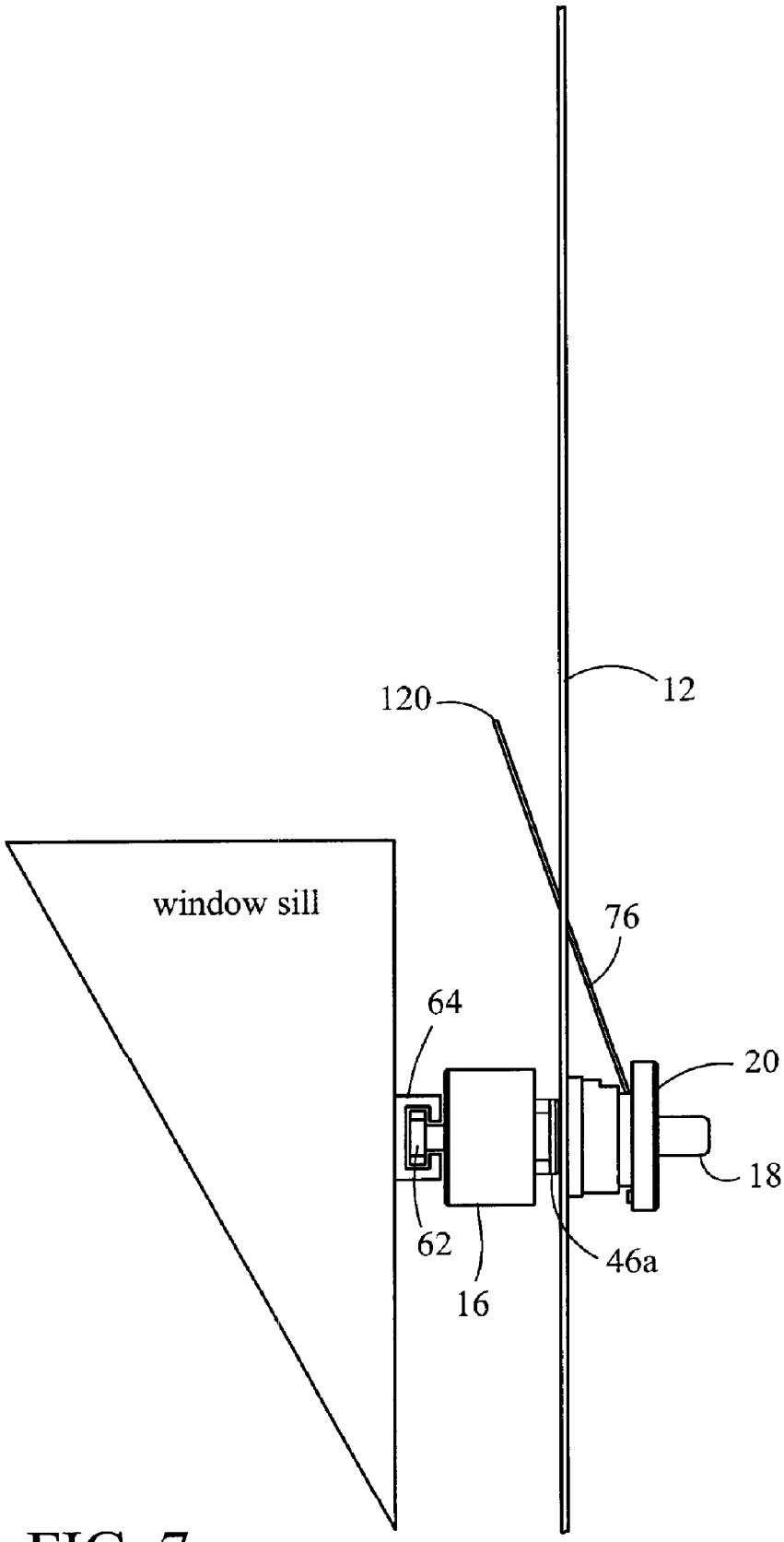
FIG. 7 shows an embodiment of the invention in which a longer leaf spring is used as part of the spring-actuated panel fastener so that said leaf spring passes through an aperture through the hurricane shutter panel for accessibility as an escape mechanism to occupants inside the building.

In yet another embodiment of the invention 10, shown in FIG. 7, the angled end 120 of the leaf spring 76 can be sized of sufficient length to extend through an appropriately sized and shaped aperture (not shown in the drawings) in the hurricane shutter panel 12. In that embodiment, the leaf spring 76 could be depressed by an occupant inside the building to release the fastener 20 from stud 18, thereby allowing the shutter panel 12 to be removed from the protected opening of the structure so as to permit escape. As illustrated by FIG. 7, the release member 14 is made unnecessary for an occupant's escape from the inside of a building by the use of a longer leaf spring 76, and thus, said release member is not included as a part of the invention in this particular embodiment.

The invention 10 can be used to secure standard hurricane/storm shutters and panels as well as plywood coverings over the openings on the exterior of a building. Additionally, the invention 10 can be adapted for operability with various commercial designs for brackets and other shutter and panel attachments connected to the exterior of a building or home.

Using the invention 10, hurricane shutters 12 can be quickly and easily released to allow the escape of occupants from a building in the event of an emergency, such as a fire. FIG. 5 illustrates the invention 10 connected to a building and to a hurricane shutter 12 while in operation. The anchor 16 is attached to an exterior wall or to a window sill of the structure to be secured by the hurricane shutters 12, and the first end 70 of removable stud 18 is inserted into two aligned central apertures 46*d* and 56 of said anchor. Once inserted into the central apertures 46*d* and 56 of said anchor 16, the annular groove 34 of said stud 18 is horizontally aligned with the two grooves 54 cut through the outer cylindrical wall 46*b* of cylindrical protrusion 46*a* that is centrally positioned on first end face 46 of said anchor 16. Central aperture 46*d* passes through the cylindrical protrusion 46*a*.

Next, a release member 14 is engaged with said anchor 16 by inserting prongs 32*a* and 32*b*, which form a stud-releasing slot 32 of said release member 14, into the grooves 54 of said anchor 16. By pressing firmly downward on the release member 14, the two-pronged second end 28 of said release member flexes apart slightly to receive and lock in position the annular groove 34 of stud 18 in the small recess aperture 36 located on said second end 28 of said release member.

An aperture 126 through the hurricane shutter panel 12 is mounted over the second end 72 of stud 18 to engage said shutter panel with the structure to be protected. Then, the hurricane shutter panel 12 is firmly secured to the structure and to the invention 10 by slidably engaging the spring-actuated panel fastener 20 over said second end 72 of stud 18. The central aperture 88 of said spring-actuated panel fastener 20 is positioned in alignment with stud 18 so that aperture 88 of said fastener 20 can be inserted over the second end 72 of said stud 18. The second face 84 of said fastener 20, through which central aperture 88 passes, is positioned to slidably engage stud 18 and to contact the hurricane shutter panel 12 on a surface of said shutter that is opposite but adjacent to the surface of said shutter panel that is in contact with end face 46*e* of the cylindrical protrusion 46*a* of said anchor 16. Physical contact between a wall 122*a* of the locking aperture 122 of leaf spring 76 and the outer cylindrical wall 68 of stud 18 provides spring tension to lock and hold said stud 18 in first locking position, thereby firmly securing the fastener 20 in position on stud 18 as well as securing the hurricane shutter panel 12 to the structure.

In the event of an emergency, an occupant of the structure preferably will press downward on the L-shaped handle 24 of the release member 14 to unlock said release member 14 from the removable stud 18. By pressing down on the release member 14, slot 32 of said release member is shifted downward in position so that the small recess aperture 36 passes over stud 18 and the large recess aperture 40 of slot 32 receives stud 18 and the cylindrical protrusion 46*a* of the anchor 16. The large recess unlocking aperture 40 is sufficiently large to pass freely over the diameter of said cylindrical protrusion 46*a* so that the release member 14, stud 18, fastener 20, and the hurricane shutter panel 12 can be cast off without any obstruction, thereby permitting the occupants of the structure to escape through the shutter-protected opening. Once the hurricane shutter 12 is removed from the opening of the structure, the occupants of said structure can easily escape to safety.

The invention 10 also allows hurricane shutters 12 to be quickly removed from a building to obtain access for rescue of the occupants of the shutter-protected building during an emergency. To obtain access to the interior of a building through a shutter-protected opening, a rescuer must depress the leaf spring 76 from the exterior of the structure so that the physical contact between inner wall 122*a* of the locking aperture 122 of said leaf spring 76 and the outer cylindrical wall 68 of stud 18 is removed. By depressing the leaf spring 76, the angle at which the locking aperture wall 122*a* is positioned in relation to the perpendicularly-oriented stud 18 is altered to decrease or eliminate the spring tension used to lock and hold said stud 18 in the secure position. When the contact and spring tension are reduced or eliminated, a rescuer can easily remove fastener 20 and hurricane shutter panel 12 from the opening of the structure, thereby allowing rescue of the building's occupants.

The instant invention has been shown and described herein in what is considered to be the most practical and preferred embodiment. The applicants recognize, however, that departures may be made therefrom within the scope of the invention and that obvious modifications will occur to a person skilled in the art.

What is claimed is:

1. A hurricane shutter escape mechanism for unlatching a hurricane shutter from a dwelling comprising:

a hurricane shutter anchor connectable to a dwelling structure to secure a hurricane shutter;

a stud removably, connected to said anchor and connectable to said hurricane shutter to hold said hurricane shutter in place;

a release member for manual release mounted on the inside of said hurricane shutter, accessible to a person in the dwelling adjacent to a dwelling opening covered by the hurricane shutter, said release member having a first position for connecting said removable stud to said anchor securing said hurricane shutter in place and a second position releasing said removable stud from said anchor allowing the hurricane shutter to be released and unfastened while inside the dwelling; and a fastener secured to the outside end of said removable stud for holding said hurricane shutter in place;

said fastener for holding said hurricane shutter in place is spring-actuated and includes a manually-releasable spring having a first locking position holding the shutter in place, and wherein said manually-releasable spring is actuated manually to loosen the fastener from the removable stud mounted on the exterior of the building.

2. The hurricane shutter escape mechanism of claim 1, wherein the release member includes a manual actuator portion, which comprises:

a planar metallic member having a rounded first end with an adjacent L-shaped handle proximal to said first end; and a tapered second end having an angled portion and a two-pronged, stud-releasing slot that is sized and shaped so as to engage an annular groove of the removable stud;

wherein said second end engages the removable stud perpendicularly so that said first end is oriented at an angle toward the structure.

3. The hurricane shutter escape mechanism of claim 2, wherein the stud-releasing slot of the release member includes:

a small recess aperture, which forms the first position connecting said removable stud to said anchor, for locking in position the removable stud, that is located proximal to a tapered end tip of the stud-releasing slot;

a large recess aperture, which forms the second position releasing said removable stud from said anchor, adjacent and connected to said small recess aperture that when centrally aligned with the removable stud allows said removable stud to disengage from the anchor; and a narrow notch adjacent and connected to the large recess aperture for providing resilient, spring-like action between two complementary prongs forming said second end and stud-releasing slot of the release member;

wherein said narrow notch allows said prongs to flex apart slightly and resiliently return to a stable non-flexed configuration once the annular groove of said removable stud has passed into the small recess locking aperture.

4. The hurricane shutter escape mechanism of claim 3, wherein said narrow notch is curved and is connected to said large recess aperture, and wherein said narrow notch terminates in a large circular recess to provide the prongs of the second end of said release member greater flexibility for biasing apart to slidably engage the removable stud.

5. The hurricane shutter escape mechanism of claim 1, wherein the anchor comprises:

a metallic cylindrical body having:

a cylindrical outer wall;

a planar first end face;

a planar second end face; and said first end face having a central aperture for receiving said stud that extends through approximately one-third to one-half of the depth of said cylindrical body;

a cylindrical protrusion centrally positioned and attached to said first end face by one or more flanges and including a central aperture for receiving the inserted removable stud, said central aperture of the cylindrical protrusion being aligned with the central aperture of the cylindrical body of said anchor and passing entirely through said cylindrical protrusion; and means for connecting said anchor to an existing hardware or structure installed on an exterior surface of the building;

wherein said cylindrical protrusion further includes a pair of complementary release member retaining grooves for slidably engaging the prongs of the release member and positioned equidistantly apart on opposing sides of the central aperture of said anchor.

6. The hurricane shutter escape mechanism of claim 5, wherein said cylindrical protrusion further comprises:

a cylindrical outer wall;

a cylindrical inner wall forming the central aperture of said cylindrical protrusion;

a planar end face including said central aperture for receiving said removable stud; and a bottom annular face to which said flanges connect to attach said cylindrical protrusion to said first end face of the anchor.

7. The hurricane shutter escape mechanism of claim 5, wherein said cylindrical protrusion is connected to said first end face of the anchor by two flanges located equidistantly apart on opposing sides of the central aperture of said anchor, and wherein said flanges separate said release member retaining grooves.

8. The hurricane shutter escape mechanism of claim 5, wherein said anchor includes a slidable plate, which is square or rectangular in shape, centrally attached to said second end face of the anchor by a necked flange comprised of a small shaft centrally positioned on the second end face as the means for securing said anchor to an exterior surface of the building; and wherein said slidable plate is inserted into and engaged with a bracket shaped for receiving the slidable plate, said bracket being either temporarily or permanently affixed to a wall or other exterior surface of the structure to be protected by a hurricane shutter panel.

9. The hurricane shutter escape mechanism of claim 1, wherein the removable stud comprises a metal dowel having a cylindrical outer wall, a rounded first end, a rounded second end, and an annular groove adjacent to said first end for engaging the stud-releasing slot of the release member.

10. The hurricane shutter escape mechanism of claim 1, wherein the spring-actuated panel fastener comprises:

a panel fastener body that includes:

a planar first face;

a planar second face;

a cylindrical outer wall; and a central aperture for receiving the removable stud that extends entirely through the said panel fastener body with openings on both the first face and the second face of the panel fastener body; and the manually-releasable spring, which comprises a leaf spring, connected to said panel fastener body.

11. The hurricane shutter escape mechanism of claim 10, wherein said panel fastener body further comprises:

a cylindrical base portion that includes said second face and said outer cylindrical wall;

a cylindrical top portion that has a greater diameter than said cylindrical base and that includes said first face and a partial annular bottom face;

a first annular groove cut from the outer cylindrical wall of the cylindrical base, said first annular groove separating said cylindrical base from said cylindrical top portion;

a second annular groove cut from around the outer cylindrical wall and the second face of said cylindrical base;

said panel fastener body also including a first recess having three flat walls and a planar bottom surface and cut from the panel fastener body across approximately four-fifths of the width of the panel fastener body and through three-fourths of the depth of said panel fastener body;

said panel fastener body farther including a shallow second recess having two parallel flat walls and a planar bottom surface and being cut out preferably from one-half the depth of said cylindrical top portion; and a threaded aperture located on the planar bottom surface of the second recess of the panel fastener body through which a rivet or screw can be inserted to attach the leaf spring to said panel fastener body.

12. The hurricane shutter escape mechanism of claim 11, wherein the cylindrical top portion of the panel fastener body is bisected into two complementary, mirror-image, partially-hemispherical halves separated by the second recess of said panel fastener body.

13. The hurricane shutter escape mechanism of claim 11, wherein a circular rubber washer of approximately the same diameter as said cylindrical base that includes a central aperture is inserted over and around the second annular groove of said panel fastener body so that said washer is nearly flush with the planar second face and outer cylindrical wall of said panel fastener body.

14. The hurricane shutter escape mechanism of claim 11, wherein the leaf spring includes:

a metallic, stainless steel, tension leaf spring that is connected by said rivet to said panel fastener body at a horizontally planar end of said spring, said horizontally planar end of said spring being of sufficient length to fit smoothly and precisely into the shallow second recess of said panel fastener body;

said leaf spring also having a longer angled end for providing spring tension to engage and hold the removable stud;

said leaf spring being of slightly less width than said first recess and said second recess of the panel fastener body so that said leaf spring maybe set into said first and said second recesses and connected to said panel fastener body; and said leaf spring having a length that is greater than the width of the cylindrical top portion of the panel fastener body;

a smaller, circular aperture through said horizontally planar end for receiving the rivet that is inserted to attach said leaf spring to said panel fastener body on the planar surface of said shallow second recess; and a locking aperture through said angled end having a diameter great enough to precisely fit and receive the removable stud that is inserted therethrough, said locking aperture being aligned with the central aperture of the panel fastener body and including an inner wall;

wherein said leaf spring can be depressed by pushing or pulling the angled end to decrease the tension exerted by said spring on the outer cylindrical wall of the removable stud.

15. The hurricane shutter escape mechanism of claim 14, wherein the leaf spring engages said removable stud in a locking position configuration when not depressed due to the angle at which the inner wall of the locking aperture of said spring contacts the cylindrical wall of said removable stud, and wherein said leaf spring releases said removable stud when the angled end of said spring is depressed due to a relaxation of tension contact by the removable stud with the inner wall of the locking aperture of said spring.

* * * * *